US007475676B2

(12) United States Patent
Remele et al.

(10) Patent No.: US 7,475,676 B2
(45) Date of Patent: Jan. 13, 2009

(54) ARRANGEMENT FOR CONTROLLING AN INTERNAL COMBUSTION ENGINE

(75) Inventors: Jörg Remele, Hagnau (DE); Uwe Rödl, Friedrichshafen (DE); Andreas Schneider, Friedrichshafen (DE); Albrecht Debelak, Graz (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 11/985,010

(22) Filed: Nov. 13, 2007

(65) Prior Publication Data

US 2008/0147293 A1 Jun. 19, 2008

(30) Foreign Application Priority Data

Dec. 14, 2006 (DE) ..... 10 2006 059 007

(51) Int. Cl.
*F02M 51/00* (2006.01)
*F02M 51/06* (2006.01)

(52) U.S. Cl. ..... 123/478; 123/480

(58) Field of Classification Search ..... 123/472, 123/478, 479, 480, 488, 490, 494, 299, 300, 123/301, 430

See application file for complete search history.

(56) References Cited

U.S. PATENT DOCUMENTS

| | | | | |
|---|---|---|---|---|
| 5,575,264 | A * | 11/1996 | Barron | 123/486 |
| 6,109,245 | A * | 8/2000 | Egger et al. | 123/490 |
| 6,766,788 | B2 * | 7/2004 | Xu | 123/490 |
| 2004/0172188 | A1 * | 9/2004 | Bowling et al. | 701/102 |
| 2008/0000453 | A1 * | 1/2008 | Remele et al. | 123/472 |

FOREIGN PATENT DOCUMENTS

| | | |
|---|---|---|
| DE | 101 17 809 | 10/2002 |
| EP | 1 203 881 | 5/2002 |
| WO | WO 97/23717 | 7/1997 |

* cited by examiner

*Primary Examiner*—Mahmoud Gimie
(74) *Attorney, Agent, or Firm*—Klaus J. Bach

(57) ABSTRACT

In an arrangement for controlling an internal combustion engine comprising an electronic engine control unit, a cylinder with a combustion chamber, a fuel injector, an intelligent electronic block with an electronic data storage unit, a computing unit, a signal measuring unit and an electric energy storage device for supplying energy to the electronic block during operation of the internal combustion engine, and control lines for the transmission of fuel injection control signals from the electronic engine control unit to the injector, the control lines for the transmission of injector control signals serve as energy transmission for the energy storage device and, at the same time, as bi-directional data exchange lines.

3 Claims, 1 Drawing Sheet

ARRANGEMENT FOR CONTROLLING AN INTERNAL COMBUSTION ENGINE

BACKGROUND OF THE INVENTION

The present invention resides in an arrangement for controlling an internal combustion engine having a cylinder with a combustion chamber and comprising an electronic control unit, at least one injector for the injection of fuel into the combustion chamber, connecting lines extending between the electronic engine control unit and the injector for the transmission of signals and an intelligent electronic component.

In an internal combustion engine, the fuel injection begin and the fuel injection end determine largely the composition of the exhaust gases. In order to keep the exhaust gas composition within the legal limits, those two characteristic values are generally controlled by an electronic engine control unit. However, in the praxis, in an internal combustion engine with a common rail fuel injection system there is always a time delay between the beginning of the energization of the injector, the movement of the control needle of the injector and the actual fuel injection. The same applies to the end of the fuel injection. In addition, there are deviations between the individual injectors and also aging effects which affect the operation of the fuel injectors overall.

In order to reduce the effects of such deviations, the production data are recorded by a coding applied to each injector for example by means of bar codes or code numbers. The data are then read by a corresponding reading apparatus into the electronic engine control unit. Another possibility is to record the individual parameters of an injector into a memory component which is arranged at the injector. During operation, these parameters are read by the engine control unit and the control values are adapted to the particular injector.

WO 97/23717 A discloses such a system with a passive memory component, that is, a memory component which does not require an energy supply. For reading out the parameters however, corresponding signal transmission lines are necessary.

It is the object of the present invention to reduce the cabling expenditures of the arrangement for controlling an internal combustion engine.

SUMMARY OF THE INVENTION

In an arrangement for controlling an internal combustion engine comprising a cylinder with a combustion chamber, a fuel injector, an electronic engine control unit, an intelligent electronic block with an electronic data storage unit, a computing unit, a signal measuring unit and an electric energy storage device for supplying energy to the electronic block during operation of the internal combustion engine, and control lines for the transmission of fuel injection control signals from the electronic engine control unit to the injector, the control lines for the transmission of injector control signals serve as energy transmission lines for the energy storage device and, at the same time, as bi-directional data exchange lines.

The invention provides for reduced wiring needs and expenses and for a communication capability of the injectors whereby for example the momentary values characterizing the operation of the injector can be gathered and read by the electronic control unit.

The data exchange is established either during a gap in the energization of the injector between two injection signal transmissions or the data information is modulated onto the injection, that is injector energization, signal.

During the injection pauses the energy storage device supplies energy to the energy storage device in the electronic block. This makes it possible to maintain a bi-directional communication between the electronic engine control unit and the injector during the injection pauses.

The invention will become more readily apparent from the following description of a particular embodiment thereof on the basis of the accompanying drawings.

DESCRIPTION OF A PARTICULAR EMBODIMENT

Figure 1:
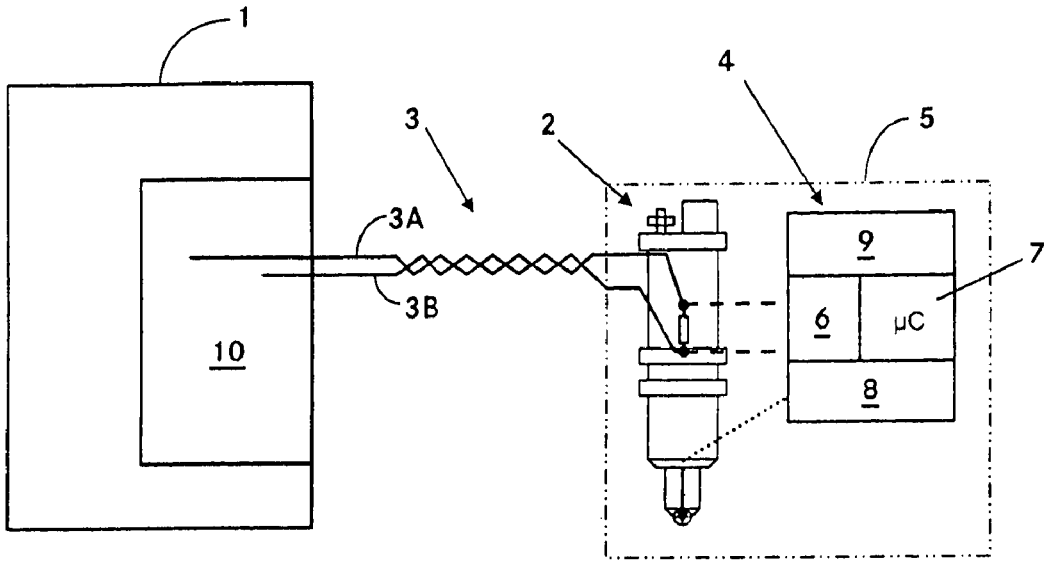
FIG. 1 shows schematically an overall arrangement.

Below the figures will be described together. The arrangement comprises the following components. An electronic engine control unit, control lines 3, an injector 2 for each cylinder and in intelligent electronic block 4 which forms a common component 5 together with the respective injector 2. As electronic block 4 in the context of the present invention, an electronic block group with electronic semi-conductor elements such as a microprocessor is to be understood which are arranged on a board, and, optionally, comprise a housing including vibration and temperature protection. The control lines are in the form of twisted pair cables that is wire cables 3A and 3B. The injector 2 may be an inductive injector or a piezo injector.

The electronic block 4 includes an electronic storage unit 6 for the storage of data, a computing unit 7, an energy storage device 9 and a measuring unit 8. Typically, the computing unit 7 includes at least one microprocessor with an operational storage unit. The measuring unit 8 detects for example opto-electronically the injection needle position and, via a temperature sensor, the injector temperature. On the basis of the sensor data determined by the measuring unit 8, the computing unit 7 determines the momentary opening and closing speeds of the injector needle, the opening point in time and the temperature behavior of the injector. Depending on the desired scope of functions additional sensor signals can be considered such as, for example, the combustion pressure.

Figure 2:
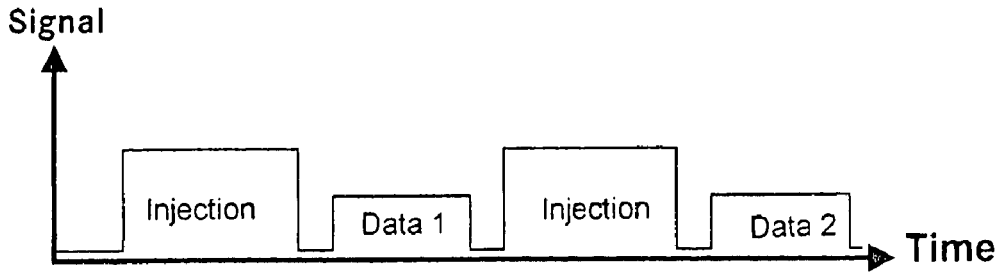
FIG. 2 shows a first signal-time diagram.

The arrangement functions as follows:

Before the start of an engine, the manufacturing data of the injector 2 are read by the electronic engine control unit 1 via the control lines 3. The manufacturing data are particularly the opening and closing speeds, an injection delay, the coil resistance, the manufacturing data and the Serial Number. During operation, the electronic engine control unit initiates an injection begin via the control lines 3 and the injector 2. The same is done for the injection end. At the same time, with the activation of the injector 2, the energy transmission from an end stage 10 of the electronic engine control unit 1 via the control lines 3 to the energy storage device 9 is initiated. During fuel injection, the energy storage device 9 is recharged. With the deactivation of the injector 2 also the transmission of energy is terminated. During the injection pause, the electronic block 4 is supplied with energy by the energy storage device 9. In the injection pauses, the control lines 3 are used for a bi-directional data exchange between the electronic engine control unit 1 and the injector 2—see in this regard the time diagram of FIG. 2. For example, the electronic engine control unit 1 can read the data (data 1) out of the storage unit 6. If necessary, it can also supplement the data in the storage unit 6 with new parameters (data 2) and initiate additional measurements to be performed by the measuring unit 8.

Figure 3:
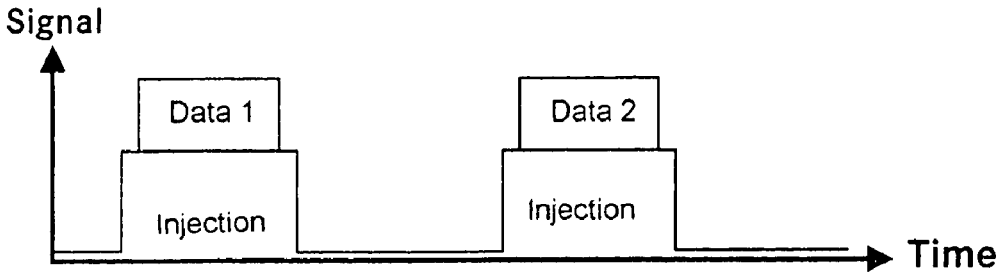
FIG. 3 shows a second signal-time diagram.

Instead of exchanging the data during the injection pauses, the data (data 1, data 2) may also be modulated onto the injection signal, see the signal-time diagram of FIG. 3.

From the arrangement of the invention as described above the following advantages can be obtained:

- the cabling is reduced to only two control wires via which the whole communication between the electronic engine control unit and the injector takes place whereby the interface amount (plugs) and the component costs are reduced,
- the use of an injector with integrated data storage unit, computing unit, measuring unit and integrated energy storage device provides for a more precise injection on the basis of momentary injector data.

What is claimed is:

1. An arrangement for controlling an internal combustion engine having a cylinder with a combustion chamber and comprising an electronic engine control unit (1), a fuel injector (2) for the injection of fuel into the combustion chamber and an intelligent electronic block (4) including an electronic data storage unit (6) for storing data, a computing unit (7), a measuring unit (8) for determining signals and an energy storage device (9) for storing electric energy and for supplying electric energy to the electronic block (4) during operation of the internal combustion engine, and control lines (3) extending between the electronic engine control unit (1) and the injector (2) for transmitting a fuel injection signal from the electronic engine control unit (1) to the injector (2), said control lines (3) serving for the transmission of energy to the energy storage device (9) and, at the same time, for the bidirectional data exchange.

2. The arrangement according to claim 1, wherein the data exchange is executed in such a way that the data are transferred during an injector energization pause between two injection signal transmissions.

3. The arrangement according to claim 1, wherein the data exchange is executed by modulating the data onto the fuel injection signal.

* * * * *